United States Patent [19]

Dove

[11] 4,351,700

[45] * Sep. 28, 1982

[54] STEAM DISTRIBUTION APPARATUS FOR THE NIP OF TWO ROLLS

[76] Inventor: Norman F. Dove, 3187 Hoskins Rd., N. Vancouver, British Columbia, Canada, 37J 3B5

[ * ] Notice: The portion of the term of this patent subsequent to May 26, 1998, has been disclaimed.

[21] Appl. No.: 162,270

[22] Filed: Jun. 23, 1980

[51] Int. Cl.[3] ..... D21F 5/02

[52] U.S. Cl. ..... 162/252; 162/272; 162/290; 162/359; 34/54; 34/73; 34/85; 34/155

[58] Field of Search ..... 162/252, 272, 290, 359, 162/206, 207; 239/139, 553.3, 568; 34/23, 34, 54, 73, 85, 155, 160, 15

[56] References Cited

U.S. PATENT DOCUMENTS

| | | | |
|---|---|---|---|
| 2,718,065 | 9/1955 | Conti | 34/23 |
| 3,097,994 | 7/1963 | Pickens et al. | 34/160 X |
| 3,560,333 | 2/1971 | Douglas et al. | 162/359 X |
| 3,945,570 | 3/1976 | Dove | 239/139 X |
| 4,163,688 | 8/1979 | Kankaanpää | 162/359 |
| 4,253,247 | 3/1981 | Bergstrom | 34/34 X |
| 4,268,976 | 5/1981 | Dove | 34/155 |

*Primary Examiner*—Richard V. Fisher
*Attorney, Agent, or Firm*—Richard H. Zaitlen

[57] ABSTRACT

Apparatus to supply steam to a paper sheet that passes by the apparatus from a leading edge to a trailing edge of the apparatus. The apparatus is adapted to be positioned adjacent the nip of two rolls and comprises a first header for steam and a first chamber to receive steam from the first header. Passages for steam are formed between the first header and the first chamber. An outlet in the first chamber permits steam to be forced against the paper sheet adjacent the leading edge of the apparatus to form a steam curtain to reduce the amount of air drawn under the apparatus by the paper sheet. A second chamber receives steam from the first header. There are passages for steam between the first header and the second chamber and outlets in the second chamber so that steam may be forced against the paper sheet to heat the sheet. The flow of steam along the length of the apparatus can be controlled.

20 Claims, 8 Drawing Figures

STEAM DISTRIBUTION APPARATUS FOR THE NIP OF TWO ROLLS

FIELD OF THE INVENTION

This invention relates to a steam supply apparatus particularly useful in the application of steam to a paper sheet.

DESCRIPTION OF THE PRIOR ART

The benefits to be derived from the application of steam to the paper sheet during the paper making process are well known. The resulting increase in sheet temperature provides increased water drainage rates, thus reducing the amount of water to be evaporated in the dryer section. Further by varying the amount of steam applied to various parts of the sheet in the cross machine direction the cross machine moisture profile of the sheet may be modified so that the moisture profile at the reel is more uniform.

Furthermore, in press section applications, where a paper sheet is passed between press rolls, it is desirable that there be no air in the sheet or the felt carrying the sheet; the presence of air makes the removal of the water from the paper and from the felt difficult. In this regard it should be pointed out that the paper, on its felt entering the press section or, subsequently in the tissue making machine, passing the Yankee cylinder, has passed over the suction boxes which tend to introduce air into the sheet and into the felt. The presence of this air tends to cool the sheet as well as to be entrained in the felt sheet sandwich.

In special applications such as in the making of tissue paper on a machine that includes a Yankee cylinder rolling in contact with a suction press roll, the sheet is transferred from the press roll to the heated cylinder (the Yankee cylinder). It is highly desirable that air be excluded from between the sheet and the Yankee cylinder as any air trapped acts as an insulator to decrease the heating efficiency and therefore drying capacity of the system.

Water drainage from the sheet is improved after the application of steam primarily because heating the sheet reduces the water viscosity and surface tension thus increasing the ability of the water to flow. Furthermore, the substitution of them for air over a suction device voids the felt/sheet sandwich of air.

In order to derive maximum benefit the steam heater must clearly be efficient. The main heat transfer takes place when the steam condenses in the sheet. A change of state takes place when the steam condenses and transforms the latent heat of the steam to sensible heat in the water. To provide an effective steam heater therefore it is imperative to provide the highest possible rate of steam condensation in the paper sheet.

In this regard it should be borne in mind that in the press application and, indeed, any application where steam supply apparatus is to be placed adjacent the nip of two rolls, the limited space available places restrictions on the design. Furthermore the location is such that potential fibre build up is a major concern. With a modern paper making machine operating at a speed of 2,500 feet per minute for each one foot heating zone width in the machine direction the available retention time in the heating zone is merely 0.024 seconds. It is therefore clear that extremely efficient contact between the heating medium (steam) and the sheets to be heated is required.

The three major requirements of a steam heater for heating a paper sheet are:

1. Maximum heat transfer, thus ensuring the maximum possible rise in temperature, with minimum steam use.
2. Compact design enabling the best possible use of the available space.
3. A design having clean lines to prevent fibre build up.

Heat transfer efficiency is increased by providing a heating zone that is free of air, a non-condensible gas. It is known that the presence of non-condensible gases in steam greatly reduces the rate of steam condensation, for example by a factor of the order of 4 to 1. The prior art provides little means to reduce the air inclusion in existing steam supply apparatus. The most common approach has been to spill voluminous amounts of steam from a heating zone area to attempt to block out the laminar flow of air entering the heating zone by being carried along with the fast moving paper sheet. Static type seals are not ideal since a positive contact cannot be made with the moving paper sheet and in actual fact a clearance in the order of $\frac{3}{8}$" must be provided.

Other factors required for an effective steam heater include (a) uniform steam distribution in the cross machine direction, where the principal heating of the paper sheet takes place in the preheat section (b) the ability to vary the steam supply to compensate for variation in water content in the sheet (so called profiling) and (c) condensate removal.

SUMMARY OF THE INVENTION

The present invention seeks to provide a steam supply apparatus having maximum heat transfer efficiency, low steam use, and compact design using the minimum amount of space adjacent the nip of co-acting rolls, for example in the press section of a paper making machine or at the Yankee cylinder of a tissue machine, that provides uniform steam distribution, good ability to profile, if needed, and the necessary condensate removal.

The apparatus of the present invention is particularly adapted to be positioned adjacent the nip of two rolls. In one aspect the invention is an apparatus useful in the press section of any paper making machine. In a further aspect the invention provides an apparatus useful at the nip of a Yankee cylinder and its attendant suction press roll in a tissue making machine or towel making machine. In the tissue making machine the tissue is passed between the nip of the Yankee cylinder and the suction press roll on a felt. The Yankee cylinder is a large heated cylinder and the suction roll has openings through its surface whereby suction may be applied to the tissue to hold the sheet in place as it passes around the roll and, at the nip, remove the air and water displaced from the sheet and the felt as the sheet and the felt are compressed at the nip. The effect of the drawing of air into the nip between coacting rolls, particularly at the Yankee cylinder, is well known. An early attempt to cure the problem was to direct steam, in a largely uncontrolled manner, into the nip between the rolls. This method represents a considerable improvement over the prior art when no attempt was made to preclude air. However, the method is extremely wasteful of steam and is essentially crude. In this regard it should be borne in mind that a modern tissue making machine may move the felt, with the tissue on it, at a speed of about 5,000 feet per minute.

Accordingly, the present invention provides a apparatus to supply steam to a paper sheet that passes by the apparatus from a leading edge to a trailing edge of the apparatus, the apparatus being adapted to be positioned adjacent the nip of two rolls and comprising: a first header for steam; a first chamber to receive steam from the first header; passages for steam between the first header and the first chamber; outlets in the first chamber whereby steam may be forced against the paper sheet adjacent the leading edge of the apparatus to form a steam curtain to heat the sheet and reduce the amount of air entering the heating zone and mixing with the steam supplied; a second chamber to receive steam from the first header; passages for steam between the first header and the second chamber; outlets in the second chamber whereby steam may be forced against the paper sheet to heat the sheet; second outlets in the second chamber so that steam may be forced towards the nip of the rolls; regulating means to control the flow of steam along the length of the apparatus.

BRIEF DESCRIPTION OF THE DRAWINGS

Aspects of the invention are illustrated by way of example in the accompanying drawings in which.

DESCRIPTION OF THE PREFERRED EMBODIMENTS

Figure 1:
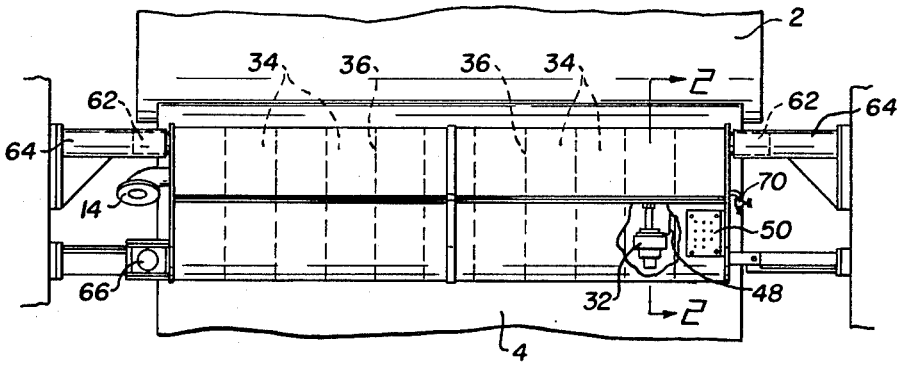
FIG. 1 is a general external view of an apparatus according to the present invention.

Referring to FIG. 1 apparatus is shown comprising a Yankee cylinder 2, in contact with a suction press roll 4. A felt (not shown) carrying a tissue (not shown) moves over the suction roll 4 to pass between the nip 6 between the suction press roll 4 and the Yankee cylinder 2. Positioned generally adjacent the nip 6 is a apparatus according to one aspect of the present invention. The apparatus has a leading edge 8, relative to paper travel as shown by arrow A, and a trailing edge 10.

The apparatus comprises a first header 12 for steam to which steam is applied, for example by the flanged inlet 14 shown in FIG. 1. There is a first chamber 16 to receive steam from the first header 12 and there are passages 18 for steam between the first header 12 and the first chamber 16 so that steam may pass from the first header 12 to the first chamber 16. There are outlets 20 in the first chamber 16 so that steam may be forced against the paper sheet adjacent the leading edge 8 of the apparatus. In this way what may be termed a steam curtain 22 is formed. The function of the curtain 22 is first to provide a primary heating of the sheet but, most importantly, to reduce greatly the amount of air drawn into apparatus by the sheet because the steam provides a curtain, substantially impenetrable to air, at the leading edge 8 of the apparatus. As particularly illustrated in FIG. 6 it is desirable that the outlets 20 in the chamber comprise a plurality of rows, for example three rows, and the outlets 20 in each row are slots (FIG. 6) or holes (FIG. 6A) staggered in relation to the slots or holes in the adjacent row. By this means air tending to be drawn into the heating zone, past the leading edge 8 of the apparatus, meets an impenetrable steam curtain and is restrained from entering the heater, and the nip 6. However, a single slot as in FIG. 6B extending along the machine can also be used particularly with relatively slow speed machines.

Figure 2:
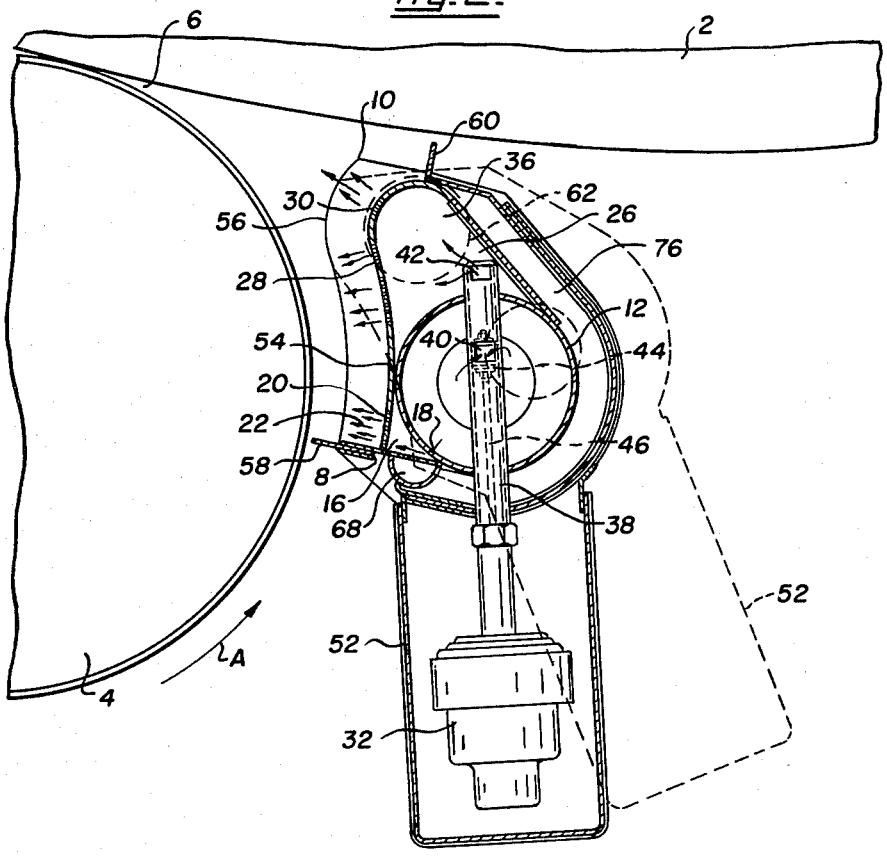
FIG. 2 is a sectional view along the line 2—2 in FIG. 1.
Figure 5:
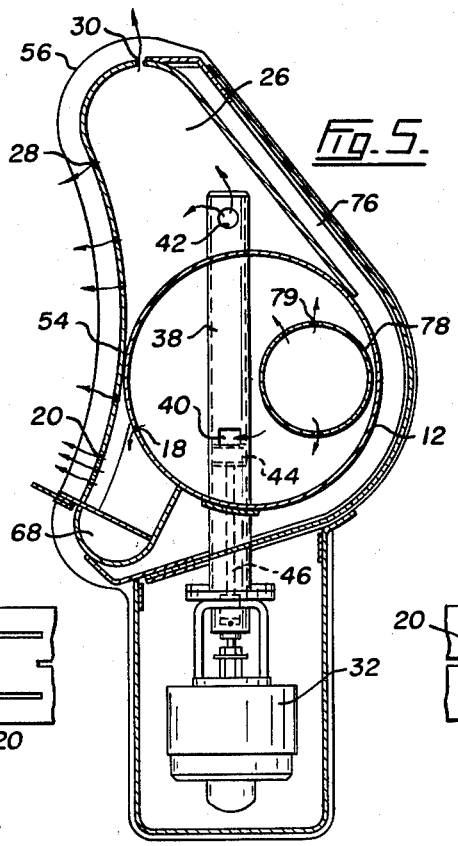
FIG. 5 is a section of a preferred embodiment of the invention.
Figure 6:
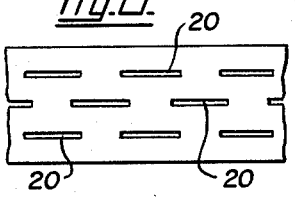
FIGS. 6, 6A and 6B illustrate details of an apparatus according to the invention.
Figure 6B:
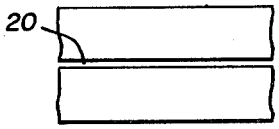
Figure 6A:
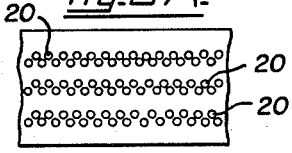

There is a second chamber 26 to receive steam from the first header. Outlets 28 in the second chamber 26 provide the main steam output and the primary heating of the paper sheet on the felt. Their arrangement may be as shown in FIGS. 6 to 6B for outlets 20. In the embodiment of FIG. 2 there are second outlets 30 in the second chamber 26 so that steam may be forced towards the nip 6 of the rolls in a manner analogous to the manner in which steam was forced to the nip in the prior art. This feature also present in the apparatus of FIG. 5 is of particular importance when the apparatus is positioned in a tissue machine, adjacent the Yankee cylinder. The outlets 30 may be as in FIGS. 6 to 6B.

There are regulating means to control the flow of steam along the length of the apparatus so that profiling of the steam application may be achieved. Profiling is of importance in the apparatus of FIG. 2 where control of the cross machine steam application can be controlled in response to, for example, computer sensing of the water profile or physical characteristics of the tissue web as it approaches the nip 6.

In the illustrated embodiment of FIG. 2 the regulating means comprises a steam regulating valve with an air actuator 32. Also fundamental to the profiling of the steam output is the division of the second chamber 26 into a plurality of compartments 34 (see FIG. 1) by the use of baffles 36 or walls as shown by broken lines in FIG. 1. There are pipes 38 extending from the first header 12 to each compartment 34. There is an inlet 40 in each pipe in the first header 12 and an outlet 42 in each pipe 38 in each compartment 34. A piston 44 is attached to the actuator 32 by connecting rod 46 to regulate the inlet 40 in tube 38 and thus regulate steam flow between the first header 12 and the compartments 34. When the steam pressure in the header 12 is changed then, for example, the piston may be moved to reestablish the required flow from the first header 12 to each of the compartments 34. The actuators 32 can all be set at the same degree of opening or, if necessary, can be varied so that a differing amount of steam is supplied to each compartment across the sheet width. Generally the control of the actuators 32 is through air tubing 48 which is coupled to an air supply apparatus, 50 one outlet of the apparatus 50 being attached to each control actuator 32. The steam outlets 18 in the header 12 at a predetermined size so that the required steam output is in the range of the operating parameters of the unit.

It should be noted that the apparatus has a smooth external casing enclosing a casing 52 around it, including the actuator 32 and main structure. This prevents the buildup of fibre on the exterior of the apparatus. The surface should also be highly polished. The inner face 54 of the apparatus conforms substantially to the shape of the suction roll 4. Furthermore there is desirably a shroud 56 extending at each end of the apparatus towards the suction roll 4 to reduce the possibility of air intake into the nip 6. There is desirably a doctor edge 58 extending from the leading edge 8 towards the suction roll 4 to reduce further the gap between the apparatus and the suction roll. It is also desirable to provide a doctor edge 60 near the trailing edge of the apparatus to prevent the ingress of air drawn in by the cylinder 2. A steam curtain can be used in its place.

As particularly illustrated in FIGS. 1 and 2 it is desirable that apparatus according to the present invention be pivotable in order that felt changes can be made without having to remove the steam heater. It is also desirable that the equipment is free to be pushed away from the suction roll on the event of, for example, felt break. As particularly illustrated in FIG. 1 the apparatus is rendered pivotable about its top by the provision of stub shafts 62 extending from the apparatus to engage in journals 64. The apparatus is positioned to remain in the working position (the position shown in solid lines in FIG. 2,) by gravity during normal operation but can, by actuating the conventional cylinder 66 be moved to the broken line position shown in FIG. 2. It can also be forced away by the felt if the felt should break during use.

The apparatus is desirably provided with condensate traps, for example, as shown by the semi-tubular member 68 shown in FIG. 2. Steam that is condensed to water may drain via the taps 70 (see FIG. 1).

FIGS. 1 and 2 show an apparatus that is suitable for application at the suction roll of a Yankee tissue machine.

The apparatus provides a steam curtain at the leading edge which prevents air from entering the heating zone which is defined between doctor edge 58 and the nip 6. Main heating of the sheet is provided by steam from outlets 28 and steam is injected into the nip 6 through outlets 30.

Figure 3:
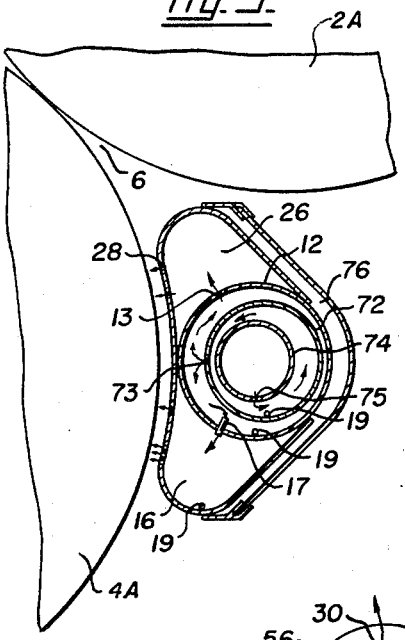
FIG. 3 is a sectional view of a further embodiment of the invention.

The apparatus shown in FIG. 3 generally resembles that of FIG. 2 except that the control of steam velocity is not achieved by valves and pipes but by the use of eccentrically arranged headers. In this regard the first steam supply header 12 has a second steam supply 72 header arranged eccentrically within it. The second steam supply header 72 has a third steam supply header 74 arranged eccentrically within it. Header 74 has outlets 75; header 72 has outlets 73. The third steam supply header is connected to a source of steam. In FIG. 3, as in FIG. 2, the exterior contours of the apparatus are smooth. There is also insulation 76 provided at the exterior of the apparatus remote from the rolls.

Figure 4:
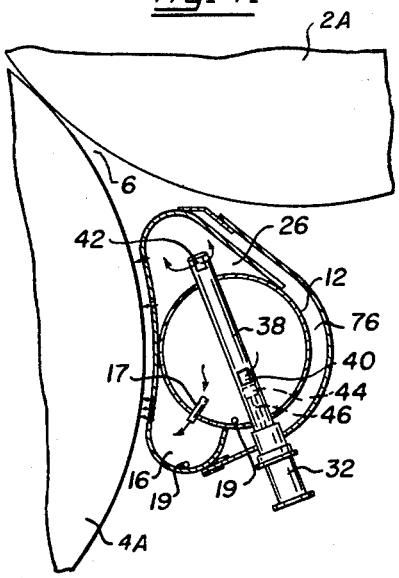
FIG. 4 is a section of a further embodiment of the invention, again shown in section.

The apparatus of FIG. 4 resembles the apparatus of FIG. 2 in that it uses a compartmentalized second chamber 26 controllable, as in FIG. 1, by a plurality of pipes 38 each pipe being controlled by a valve controlled by an actuator 32. FIG. 4 also illustrates the use of tubes as a means of preventing the passage of condensate from the header 12 to chamber 16. FIG. 4, as the embodiment of FIG. 3, is a more general application than FIG. 2 and may be considered a general apparatus for applying steam in the vicinity of the nip 6 between the two rolls 2A and 4A. It is of principal application in the press section of a paper making machine while the embodiments of FIGS. 1, 2 and 5 are of particular application in a tissue machine featuring a Yankee cylinder 2 and a suction roll 4.

The units of FIGS. 3 and 4 provide uniform steam distribution across the width of the paper sheet together with a means to prevent air from entering the heating zone. The geometry of the units is such that the design will prevent build up of fibres, i.e. the unit is suitably contoured with crevice-free external surfaces.

With reference to FIG. 3, steam enters header 74 which discharges steam into header 72 via outlets 75 which become progressively larger as they approach the end of the header 74 remote from the inlet. The hole pattern is such that uniform steam output is provided along the header for a steam flow rate determined to be in the mid flow operating range of the unit. The steam discharges from outlets 75 onto the inside wall of header 72 and travels round to the unrestricted part of header 72, which acts as an expansion zone that provides a first cross machine pressure dampening zone. The steam continues on from this expansion chamber and converges towards the steam outlets 73. This converging provides an additional zone of pressure change which also results in a further dampening of cross machine pressure. Steam discharges from header 72 through outlets 73 into header 12. Steam is supplied to the chamber 26 via outlets 13 in header 12. Steam discharges from chamber 26 to the sheet through outlets 28.

Chamber 16 provides the source of steam for the steam curtain 22 at the leading edge of the unit and has a minor preheat function. Steam enters chamber 16 from header 12 via a row of tubes 17 provided to ensure that condensate does not discharge from header 12 into chamber 16 and condensate that forms in chamber 16 is removed via a drain pipe 19 that taps from the bottom of chamber 16. Chamber 16 discharges steam onto the sheet via the steam curtain 22 as described above.

The geometry of the unit shows an arrangement whereby all external surfaces of the unit that may come in contact with fibre i.e. loose fibres that may separate from the sheet as the sheet travels round the press roll, are contoured as shown in FIG. 3. The entire outside surface in this vicinity should preferably be lightly polished to further prevent fibres from adhering to the surface. The outlets 20 should preferably be comprised of small holes per FIG. 6A (in the order of 1/16" diameter) and spaced such that a fibre could not staple across from one hole to the other in the machine direction.

There are three condensate taps 19 to remove condensate that may form in the unit. Condensate is removed from the unit from the bottom of header 72, the bottom of header 12, and the bottom of chamber 16.

The unit is insulated with insulation item 76 which is encased in a stainless steel jacket.

Steam may be deliberately discharged into the nip of the press at item 6 or, depending on the process requirements, may be prevented from discharging freely into the nip by utilizing a steam curtain arrangement at the trailing edge of the unit similar to that which is utilized at the leading edge of the unit. However, the apparatus of FIGS. 3 and 4 is for the press section and steam is not generally directed into the nip 6.

FIG. 4 shows a unit for application at the same location as that shown in FIG. 3 but uses a feature of the FIG. 2 apparatus. This particular unit has chamber 26 compartmentized with baffles in order to provide means of interrupting the uniformity of steam in the cross machine direction. Headers 74 and 72 are not required in this arrangement since the cross machine steam distribution is adjusted with the incremental moisture profile control valve and actuator 32. Steam discharges from header 12 through the openings 40 in the pipe 38 as in FIG. 2 and discharges into the compartmentized chamber via outlets 42. Each compartment is supplied with steam with its own individual incremental moisture profile control valve and actuator 32. The profiling valve arrangement provides a means of tapping a source of steam from within header 12 at a point that is above the region that may contain condensate.

The apparatus of FIG. 5 is useful in a tissue machine. It represents a modification of the apparatus of FIG. 2 but also uses one of the features of FIG. 3 in that the first header 12 has arranged within it a steam supply header 78 connected to a source of steam. Header 78 has outlets 79. The source of steam is conventional. The eccentric arrangement of the headers 12 and 78, as shown in FIG. 5, also assists in the regulation of the supply of steam to the individual compartments. In the particular illustrated embodiment of FIG. 5 the actuator 32 is a conventional air actuator with the addition of a connecting rod 46 and a piston 44.

The apparatus according to the present invention is versatile and compact. The profiling valves may easily be automatically controlled by an on machine computer. Furthermore, substantial economies are available both in compactness of apparatus, in permitted speed of the paper making machine and in steam use.

In experiments carried out it has been shown that a greater than 10% increase in machine speed is possible using the apparatus illustrated in FIG. 2. Using such an apparatus a machine previously operating at 4,600 feet per minute could be operated at speeds of about 5,100 feet per minute. The apparatus consumes steam at the rate of approximately 0.28 tons of steam per ton of paper, a substantial saving over the prior art which tends to use steam at the rate of 0.8 to 1 ton of steam per ton of paper.

I claim:

1. Apparatus to supply steam to a paper sheet that passes by the apparatus from a leading edge to a trailing edge of the apparatus, the apparatus being adapted to be positioned adjacent the nip of two rolls and comprising:

a first header for steam;

a first chamber to receive steam from the first header;

passages for steam between the first header and the first chamber;

an outlet in the first chamber whereby steam may be forced against the paper sheet adjacent the leading edge of the apparatus to form a steam curtain to reduce the amount of air drawn under the apparatus by the paper sheet;

a second chamber to receive steam from the first header;

passages for steam between the first header and the second chamber;

outlets in the second chamber whereby steam may be forced against the paper sheet to heat the sheet;

regulating means to control the flow of steam along the length of the apparatus; the first and second chambers being formed on the exterior of the first header with a portion of the first header forming a wall of the first chamber and a further portion of the first header forming a wall of the second chamber;

an inner wall of the apparatus conforming generally to the shape of an adjacent portion of a roll surface; and a first part of said inner wall forming a wall of said first chamber and containing the outlet in the first chamber, a second part of said inner wall forming a wall of second chamber and containing said outlets in the chamber.

2. Apparatus as claimed in claim 1 in which the outlet in the first chamber comprises a plurality of openings arranged in rows, each row being at a different distance from the leading edge of the apparatus and the openings in each row being staggered in relation to the openings in an adjacent row.

3. Apparatus as claimed in claim 1 including condensation traps at the lowermost point of each header and at each chamber and removal means whereby condensation can be removed from each chamber and header.

4. Apparatus as claimed in claim 1 including a shroud extending from each end of the inner wall towards the adjacent roll.

5. Apparatus as claimed in claim 1 including a doctor edge extending from the leading edge adjacent the first roll to reduce the gap between the leading edge and the roll.

6. Apparatus as claimed in claim 1 including a doctor edge on an upper edge extending towards the second roll to reduce the gap between the apparatus upper surface and the second roll.

7. Apparatus as claimed in claim 1 including second outlets in the second chamber so that steam may be forced towards the nip of the rolls.

8. Apparatus as claimed in claim 1 including means to permit pivoting of the apparatus; and means to pivot the apparatus from a working position to a retracted position.

9. Apparatus as claimed in claim 8 in which there are pivot bearings at each end of the apparatus; and a pneumatic cylinder to move the apparatus about the pivot bearings.

10. Apparatus as claimed in claim 1 in which the regulation means includes a second header within the first header arranged eccentrically relative to the first header;

passages to permit steam to move from the second header to the first header;

a third header within the second header arranged eccentrically relative to the second header;

passages to permit steam to move from the third header to the second header; and the eccentric arrangement of the headers establishing a pressure drop as steam passes from one header to another header to assist in establishing uniform flow of steam across the apparatus.

11. Apparatus as claimed in claim 10 in which there is a second header in the first arranged eccentrically relative to the first header to assist in providing a uniform flow of steam to the pipe inlets in the first header.

12. Apparatus as claimed in claim 1 in which the second chamber is divided into a plurality of compartments;

a pipe extending from the first header to each compartment; and valve means for each pipe to control the flow between the first header and the respective compartment.

13. Apparatus as claimed in claim 12 including means for manually controlling the valve means.

14. Apparatus as claimed in claim 12 in which the valve means comprises a pressure-sensitive actuator;

an inlet in each pipe in the first header;

an outlet in each pipe in each compartment; and a piston attached to the actuator to regulate the inlet in the first header to regulate steam flow between the first header and the second chamber compartments.

15. In a tissue apparatus including a cylinder and a suction roll defining a nip between them through which a felt carrying the tissue passes, the improvement that comprises a steam supply apparatus positioned adjacent the nip, the apparatus having a leading edge and a trailing edge relative to tissue direction and comprising:

a first header for steam;

a first chamber to receive steam from the first header through passages communicating the first chamber and the first header;

outlets in the first chamber whereby steam may be forced against the paper sheet adjacent the leading edge of the apparatus to form a steam curtain to reduce the amount of air drawn under the apparatus by the sheet;

a second chamber to receive steam from the first header through passages communicating the first header and second chamber;

outlets in the second chamber whereby steam may be forced against the paper to conduct the main heating of the sheet prior to its entering the nip of the rolls;

outlets in the second chamber so that steam may be forced towards the nip of the rolls to exclude air from the nip;

regulating means to control the flow of steam along the length of the apparatus, the regulating means comprising the division of the second chamber into a plurality of compartments;

a pipe joining each compartment to the first header for steam;

a piston arranged in each pipe;

the first and second chambers being formed on the exterior of the first header with a portion of the first header forming a wall of the first chamber and a further portion of the first header being a wall of the second chamber;

an inner wall of the apparatus conforming generally to the shape of the adjacent suction roll surface; and a first part of said inner wall forming a wall of said first chamber and containing the outlets in the first chamber; a second part of said inner wall forming a wall of said second chamber and containing said outlets in the second chamber;

whereby flow between the first header and the individual compartments may be regulated to provide a steam profile across the width of the paper on the tissue apparatus.

16. Apparatus as claimed in claim 15 in which there is a second header for steam arranged eccentrically within the first header and connected to a source of steam, the eccentric arrangement of the headers providing a low pressure zone to regulate the flow of steam within the first and second headers.

17. Apparatus as claimed in claim 15 in which regulating means to control the flow of steam along the length of the apparatus includes an automatic control valve; and the piston extends from the valve to the inlet in the pipe in the first header for steam whereby the amount of steam entering the pipe and passing to the second chamber compartments may be controlled.

18. Apparatus as claimed in claim 15 in which the steam supply apparatus is adapted to pivot about a point adjacent the cylinder; and means to pivot the steam supply apparatus about the pivot point.

19. Apparatus as claimed in claim 15 including raised tubes formed in the passages to avoid the passage of condensate through the passages.

20. Apparatus as claimed in claim 19 in which there are condensate taps at the lowermost points of the headers and the chambers.

* * * * *